US005192821A

United States Patent [19]

Goldstein et al.

[11] Patent Number: 5,192,821

[45] Date of Patent: Mar. 9, 1993

[54] MOUTHPIECE FOR A SINGLE-REED WOODWIND INSTRUMENT

[76] Inventors: Bradley Goldstein, 110 Longwood Ave., Brookline, Mass. 02146; Martin Goldstein, 87-10 204th St. Apt A-28, Hollis, N.Y. 11423

[21] Appl. No.: 612,799

[22] Filed: Nov. 14, 1990

[51] Int. Cl.[5] ..... G10D 9/02

[52] U.S. Cl. ..... 84/383 R; 84/385 R

[58] Field of Search ..... 84/383 R, 383 A, 382, 84/385 R, 380 R

[56] References Cited

U.S. PATENT DOCUMENTS

| | | | |
|---|---|---|---|
| 787,127 | 4/1905 | Starke | 84/383 R |
| 1,385,239 | 7/1921 | Babbitt et al. | 84/383 R |
| 1,413,929 | 4/1922 | Naujoks et al. | 84/383 R |
| 1,525,105 | 2/1925 | Sinclair | 84/383 R |
| 1,771,157 | 7/1930 | Arthur | 84/383 R |
| 2,527,988 | 10/1950 | Dillon | 84/383 R |
| 2,837,003 | 6/1958 | Collis | 84/383 R |
| 4,347,776 | 9/1982 | Grass et al. | 84/383 R |
| 4,449,439 | 5/1984 | Wells | 84/383 R |

FOREIGN PATENT DOCUMENTS

| | | | |
|---|---|---|---|
| 749650 | 7/1933 | France | 84/383 R |

OTHER PUBLICATIONS

Brilhart, Advertisement for Brilhart Musical Instrument Corp.

*Primary Examiner*—Michael L. Gellner
*Assistant Examiner*—Eddie C. Lee
*Attorney, Agent, or Firm*—Weingarten, Schurgin, Gagnebin & Hayes

[57] ABSTRACT

A mouthpiece is disclosed for use with a single-reed woodwind instrument such as a clarinet or saxophone. The mouthpiece has a unique reed holding assembly which includes a slot for constraining lateral movement of a reed and facilitating its longitudinal positioning. The reed is held in place by a holding device that includes at least one resilient band seated in at least one locating groove formed about the circumference and disposed in a central region along the mouthpiece. In a preferred embodiment, the mouthpiece includes a chamber and proximal portion which are constructed of two distinct materials with different acoustical resonance properties, thereby providing improved tonal and acoustic performance. In the embodiment for use with a clarinet, the chamber portion includes clarinet sealing rings for forming a durable and tight seal with the barrel of the clarinet.

17 Claims, 2 Drawing Sheets

MOUTHPIECE FOR A SINGLE-REED WOODWIND INSTRUMENT

FIELD OF THE INVENTION

This invention relates to musical accessories, and particularly to mouthpieces for use with single-reed woodwind instruments.

BACKGROUND OF THE INVENTION

All wind instruments, and particularly single-reed woodwind instruments, include a mouthpiece for facilitating a vibratory response which is the origin of the instrument's sound. In single-reed woodwind instruments, a cane-type reed vibrates in response to a moving stream of air. It is known that the nature of the mouthpiece significantly affects the quality of the sound produced by the instrument, as well as determining its playability.

Mouthpieces are commonly constructed from a variety of materials, e.g., rubber and plastic. These materials tend to dampen vibration of the reed, thereby causing a dull non-projecting sound. Mouthpieces made completely of metal are too bright and difficult to control. Rubber mouthpieces molded about a thin metal core are difficult to manufacture, and display inferior acoustic properties.

To satisfactorily modulate the sound quality of an instrument with a currently available mouthpiece, and to reach the extreme portions of the instrument's tonal register, strenuous control of a musician's embouchure is required. Thus, to the extent that the musician must work hard while playing, he or she is distracted from the goal of creative expression. An instrument with improved playability reduces the effort a player must exert to obtain a desired sound.

In the case of a single-reed woodwind instrument such as a saxophone or clarinet, playability is determined by an interaction between a reed and a ligature which secures the reed to the mouthpiece. Although there are many ligatures that are intended to maximize the vibratory response of the reed, they are commonly constructed of rigid or dampening materials, such as metal or plastic, that hinder free vibration of the reed. In known mouthpieces where elastomeric bands are used to hold a reed in place, consistent, optimal and stable placement of the reed and ligature is difficult to achieve.

Optimal reed placement is important for obtaining a satisfactory sound from a woodwind instrument. For beginning students of the saxophone and clarinet, reed placement is commonly difficult to master. Lateral reed shift, experienced when placing or tightening a ligature, can cause off-tones and even damage the reed. The ability to affect quick reed placement without lateral readjustment is needed to reduce missed time during performances, as well as to avoid other frustrations encountered during reed placement. There are devices that aid reed placement, but they tend to be bulky, thereby reducing the overall effectiveness of the mouthpiece. Others offer solely visual guidance and do not physically restrict lateral reed shift.

SUMMARY OF THE INVENTION

A mouthpiece is provided that enhances the overall vibratory response of a single-reed woodwind instrument, such as a clarinet or a saxophone. The mouthpiece includes a plurality of improvements that each independently enhance the sound of the instrument. An instrument that includes all the improvements enjoys a synergistic effect, thereby providing a resulting sound that is audibly improved with respect to known mouthpieces. The mouthpiece of the invention has a unique reed holding assembly including a reed groove disposed at least along a proximal portion of the mouthpiece. The reed groove serves to constrain lateral movement of the reed and facilitate positioning of the reed by a player. The reed is held in place by a reed holding device including at least one resilient ring or band, that is seated in a locating groove formed about the circumference of the mouthpiece. Alternatively, the reed can be held in the reed groove using any known ligature type, such as metal band ligatures. The reed groove serves to embed the reed in the material of the proximal portion of the mouthpiece, thereby enhancing the passage of vibrations from the reed to a distally disposed chamber portion. Moreover, embedding the reed in the reed groove of the mouthpiece reduces the stretching required of the resilient band for securing the reed, as compared with embodiments without a reed groove, thereby decreasing the contacting area between each resilient band and the reed, consequently improving vibrational freedom. Furthermore, the reed groove limits lateral movement of the reed, thereby reducing the need for a tight ligature to provide a strong constricting force for securing the reed to the mouthpiece. The resilient band facilitates free vibration of the reed, thereby making the instrument easier to play and more responsive, resulting in a significantly improved and desirable sound. In a preferred embodiment, a single-reed woodwind mouthpiece includes a resilient reed-holding device, such as a VIBRATHANE (TM) ring or band that provides superior vibrational response over the entire tonal register of the instrument, as well as providing improved playability. In a further preferred embodiment, the distal chamber portion of the mouthpiece is made of a first material with relatively greater acoustical resonance properties, such as brass, aluminum, steel, glass-type material, ceramic or graphite composite, and the proximal portion, i.e., the portion contacted by a player's mouth, is made of a second material with relatively lesser acoustical resonance properties, such as rubber, plastic, crystal, glass-type material, ceramic or graphite composite. The mouthpiece displays tonal and acoustic properties that arise from the combination of two distinct materials. The chamber portion of the mouthpiece includes a bore, an outside diameter, and a depth adapted for enhancing the vibratory response. Another preferred feature of the mouthpiece is a proximal portion with a tip that has a width that is substantially equal to the width of a standard reed and has a shape that is intermediate between a standard rubber and a standard metal mouthpiece, thereby facilitating ease of migration for a new player of the mouthpiece of the invention, regardless of the player's experience with prior equipment.

DESCRIPTION OF THE DRAWING

The invention will be more fully understood from the following detailed description, in conjunction with the accompanying figures, in which.

DETAILED DESCRIPTION OF THE INVENTION

Figure 1:
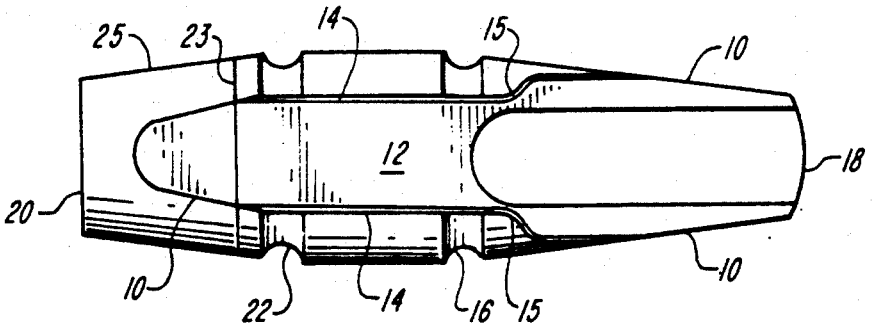
FIG. 1 is a bottom-view of a saxophone mouthpiece.

With reference to FIG. 1, a mouthpiece for a saxophone is shown in an orientation such that its lay 10 is visible. The lay 10 is a planar surface upon which a reed rests when it is in playing position. A reed groove 12 is defined by reed groove walls 14 and the portion of the lay 10 that is bounded by the walls 14. The walls 14 are also visible in FIG. 2A. Also, FIG. 2B provides a view taken along B—B of FIG. 2A that shows the reed groove 12 and its reed groove walls 14. The beginning 15 of the reed groove 12 is located so that, when a reed is disposed in playing position, 25% to 35% of the reed extends beyond the beginning 15 of the reed groove 12. The width of the reed groove 12 is about 10% to 3% wider than the average width of the heel of a standard woodwind reed. The depth of the reed groove 12 preferably does not exceed 80% of the thickness of the heel of a reed disposed in the grove 12.

A proximal ligature seating groove 16 is a channel extending about a circumference of the mouthpiece, and is sized to accommodate a resilient band ligature. The groove 16 is located approximately midway between a proximal tip 18 and the distal end 20 of the mouthpiece but may be located anywhere to afford contact of the resilient band 24 with the heel of the reed. A distal ligature seating groove 22 is a channel similar to the groove 16. The rear groove is located midway between the forward groove and the distal end 20 of the mouthpiece.

Figure 4:
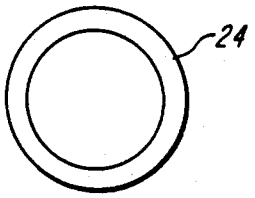
FIG. 4 is a side-view of a resilient band ligature.

When a reed is in playing position, i.e., placed upon the lay 10, seated between the walls 14 of the reed groove 12, and coextensive with the proximal tip 18, the reed can be secured using at least one resilient band 24, shown in FIG. 4. A resilient band ligature 24 is seated in at least one, and preferably each of the seating grooves 16 and 22. The resilient band ligature may also be positioned anywhere along the length of the mouthpiece between the two grooves 16 and 22. The ligature 24 is made of a vibrationally non-damping material, such as VIBRATHANE (TM), that sympathetically vibrates with the reed and mouthpiece. The inner diameter of the ring ligature 24 is preferably 10% smaller than the depth of the ring ligature seating groove. To enhance the visual appeal of the resilient band ligature 24, it can be made of a colored, phosphorescent or luminous material.

Figure 2A:
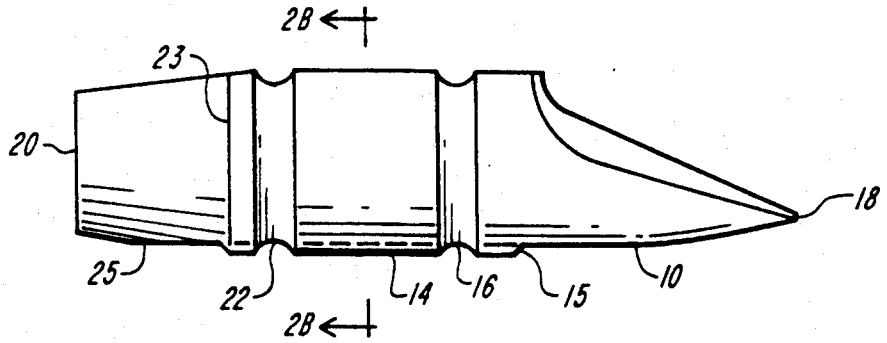
FIG. 2A is a side-view of the mouthpiece of FIG. 1.
Figure 2B:
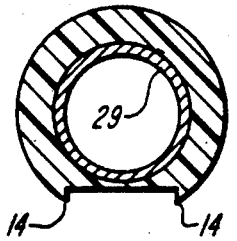
FIG. 2B is a cutaway view taken along the line 2B—2B of FIG. 2A.
Figure 3:
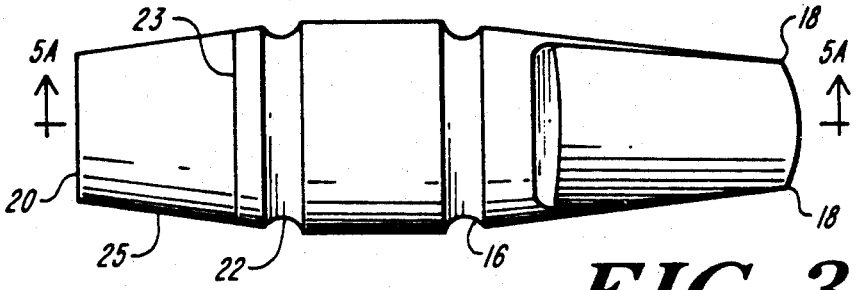
FIG. 3 is a top-view of the mouthpiece of FIG. 1.

Referring to FIG. 3, a top view of the embodiment of FIGS. 1, 2A, and 2B is provided that shows the proximal tip 18 of the mouthpiece. The width of the tip 18 is preferably no greater and no less than the width of the tip of a typical woodwind reed.

Figure 5A:
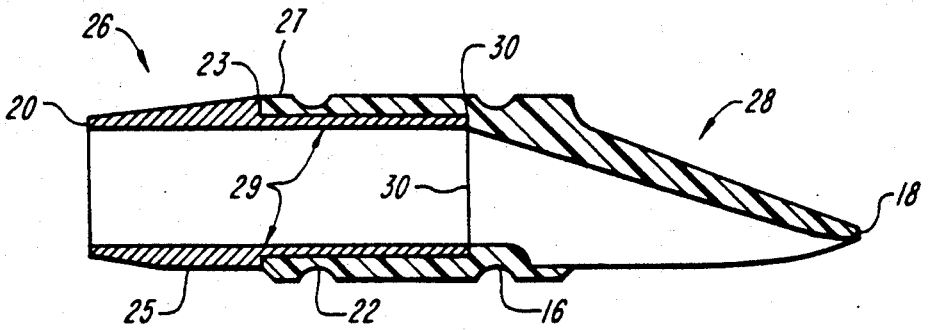
FIG. 5A is a cutaway side-view of the mouthpiece of FIGS. 1-3.

With reference to FIG. 5A, the embodiment of FIG. 3 is shown in cross-section along the line 5A—5A. A segment 29 of the distal chamber portion 26 is inserted into the distal end 27 of the proximal tip portion 28. Preferably, the thickness of the wall of the distal end 27 exceeds the thickness of the wall of the segment 29 to be inserted by 25%. Also, it is preferred that the segment 25 wherein metal is exposed be no less than 25% of the total length of the mouthpiece from the distal end 20 to the proximal tip 18. The segment 29 of the distal chamber portion 26 fits within the distal end 27 of the proximal tip portion 28 such that a thin cylindrical volume of space exists between the inner surface of the distal end 27 and the outer surface of the segment 29. To join the segment 29 and the distal end 27, a space-filling adhesive material with vibrationally non-damping properties, such as DEVCON (TM) METALSET (TM), is disposed within the thin cylindrical volume of space, thereby enhancing the overall vibratory response of the mouthpiece. Alternatively, the segment 29 of the distal chamber portion 26 fits within the distal end 27 of the proximal tip portion 28 such that a press fit can be achieved. It is preferred that the proximal end 30 of the distal chamber portion 26 abut the inner confronting surface of the proximal tip portion 28 snugly and flushly, so as not to create a ledge, i.e., the inner surface of the proximal tip portion 28 is preferably substantially continuous with the inner surface of the distal chamber portion 26. A substantially continuous inner surface will reduce the formation of aberrant sound waves due to reflection by undesirable projecting surfaces. Also, the outer surface of the proximal tip portion 28 is preferably substantially continuous with the outer surface of the distal chamber portion 26 so as to create a smooth surface transition. To enhance the visual appeal of the proximal tip portion 28, it can be made of a colored, phosphorescent or luminous material.

Figure 5B:
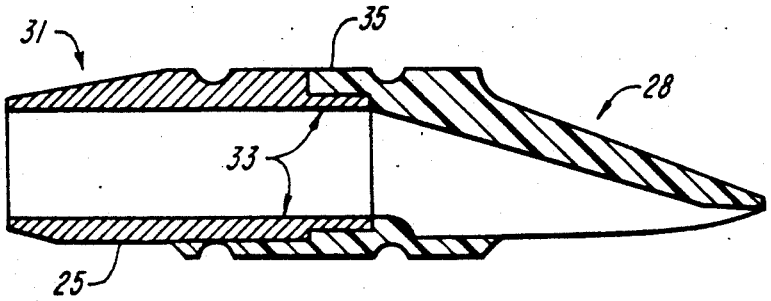
FIG. 5B is a cutaway side-view of an alternate embodiment of a mouthpiece with more exposed metal than the embodiment of FIG. 5A.

An alternate embodiment, shown in FIG. 5B, a segment 33 of the distal chamber portion 31 is inserted into a shortened distal end 35 of the proximal tip portion 28. Preferably, the thickness of the wall of the distal end 35 exceeds the thickness of the wall of the segment 33 to be inserted by 25%. The shortened segment 33 of the distal chamber portion 31 fits within the distal end 35 of the proximal tip portion 28 such that a thin cylindrical volume of space exists between the inner surface of the distal end 27 and the outer surface of the segment 29, as in the embodiment of FIG. 5A. Alternatively, a press fit can be used to join portions 28 and 31 as discussed above.

In another embodiment, the proximal tip portion 28 is integral with the distal chamber portion 31, and consequently, the portions 28 and 31 are made of the same material, and seam 23 of FIGS. 1, 2A, 3, and 5A is absent.

Figure 6A:
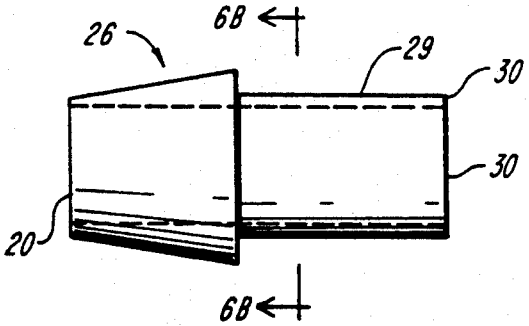
FIG. 6A is a side-view of the chamber portion of the mouthpiece of FIGS. 1-3, and 5A.
Figure 6B:
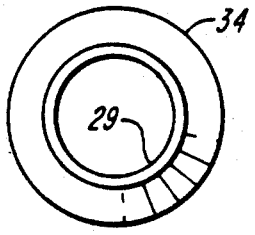
FIG. 6B is a view taken along the line 6B—6B.

With reference to FIGS. 6A and 6B, the distal chamber portion 26 is shown separated from the proximal tip portion 28. The portion 26 includes the proximal segment 29 which includes the proximal end 30, and is made of a material that enhances acoustic vibration produced in the proximal tip portion 28 when a musician blows into the instrument, and maintains this desirable condition with a minimum of effort on the part of the musician. Such materials include brass, aluminum, steel, crystal, glass-type materials, ceramic and graphite composites. The vibration of a chamber made from one of these materials is significantly fuller than could be produced by a mouthpiece made of rubber or plastic.

Figure 7:
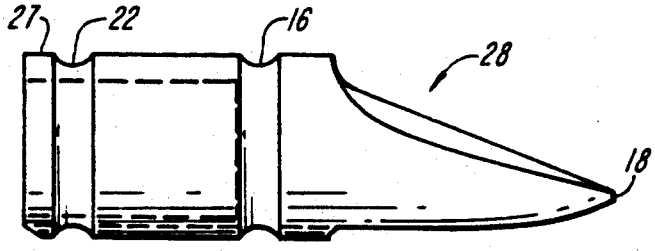
FIG. 7 is a side-view of the proximal portion of the mouthpiece of FIGS. 1-3, and 5A.

Referring to FIG. 7, the proximal tip portion 28 is shown separated from the distal chamber portion 26. The portion 28 is made of a material chosen from the group including brass, aluminum, steel, crystal, glass-type materials, ceramic and graphite composites, wherein the material is of lesser resonance-promoting properties than the material used to form the chamber section, to provide a dynamic yet controlled sound when the instrument is played.

Thus, by combining a proximal tip portion of a first material with a first resonance-promoting property with a portion of a second material with a second and greater resonance promoting property, which serves to augment the vibratory response of the overall mouthpiece, the sound of the instrument acquires a significantly enhanced mellow texture, along with a fuller, fatter, and better cutting sound which are qualities prized by musicians. Another desirable feature that results is enhanced sound stability over the entire range of the instrument. The musician can easily attain a variety of sound qualities ranging from mellow, usually associated with rubber-type mouthpieces, to a cutting and brilliant tone, usually associated with metal mouthpieces.

Figure 8:
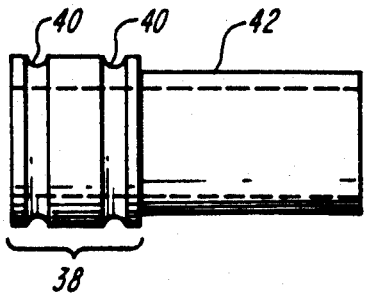
FIG. 8 is a chamber portion of a clarinet mouthpiece that can fit into the proximal portion of a clarinet embodiment of the invention, as shown in FIG. 7.

Referring to FIG. 8, a chamber portion of a clarinet-type mouthpiece assembly is shown, which is analogous to the chamber portion of the saxophone-type mouthpiece assembly shown in FIG. 6A. A barrel mating section 38 of the clarinet mouthpiece assembly includes two or more resilient band seating grooves 40 of a size sufficient to accommodate the resilient band. A resilient band, made of rubber or similar material, is seated in each of the seating grooves 40. Resilient bands do not wear or deteriorate as does cork, the most widely used sealing material in the art. The resilient bands cooperate with the barrel to form a deterioration-free and leak-free seal even under the most adverse playing conditions. The resilient bands should have a diameter so as to fit snugly in each resilient band seating groove 40, and form an air-tight seal when the mating section 38 is inserted into the barrel of a clarinet.

In a preferred embodiment that includes two resilient bands, the length of the barrel mating section 38 is equal to that of a segment 42 that mates with a corresponding tip portion analogous to the tip portion shown in FIG. 7. The resilient band seating grooves 40 are preferably located equidistant from the center of section 38.

Other modifications and implementations will occur to those skilled in the art without departing from the spirit and the scope of the invention as claimed. Accordingly, the above description is not intended to limit the invention except as indicated in the following claims.

What is claimed is:

1. A single-reed woodwind mouthpiece assembly including a proximal tip portion and a distal chamber portion, said mouthpiece assembly having enhanced vibrational quality, stability, and response comprising:

a lay disposed in at least said proximal tip portion, upon which a reed rests when said reed is in playing position;

a reed groove including reed groove walls extending upward from at least a portion of said lay for limiting transverse slippage of the reed; and reed holding means for maintaining the reed in playing position within said reed groove.

2. The single-reed woodwind mouthpiece assembly of claim 1 wherein:

said distal chamber portion is made of a first material with relatively greater acoustical resonance-promoting properties; and said proximal tip portion is made solely of a second material with relatively lesser acoustical resonance-promoting properties, and is connected to said distal chamber portion.

3. The mouthpiece assembly of claim 2 wherein said first material with relatively greater acoustical resonance properties is chosen from the group consisting of brass, aluminum, steel, crystal, glass, ceramic and graphite composite.

4. The mouthpiece assembly of claim 2 wherein said second material with relatively lesser acoustical resonance properties is chosen from the group consisting of rubber, plastic, crystal, glass, ceramic and graphite composite.

5. The mouthpiece assembly of claim 1 wherein the width of said reed groove s about 1% to 3% wider than the width of the heel of a reed for a single-reed woodwind instrument.

6. The mouthpiece assembly of claim 1 wherein the depth of said reed groove does not exceed eighty percent of the thickness of the heel of a reed disposable in said reed groove.

7. The mouthpiece assembly of claim 1 wherein the beginning of said reed groove is disposed such that when a reed is disposed in playing position, 25% to 35% of the reed extends beyond the beginning of said reed groove.

8. The mouthpiece assembly of claim 1 wherein said reed holding means includes at least one independently positionable resilient band made of a vibrationally non-damping material capable of sympathetically vibrating with the reed.

9. The mouthpiece assembly of claim 8 wherein said resilient band is seated in at least one locating groove formed about the circumference of said proximal tip portion.

10. The mouthpiece assembly of claim 8 wherein said vibrationally non-damping material is an elastomer.

11. The mouthpiece assembly of claim 1 wherein said reed holding means includes a metal ligature with two clamping screws and a wide metal band that wraps around the circumference of the mouthpiece for holding a reed in place.

12. The mouthpiece assembly of claim 8 further including:

a ligature groove for seating said resilient band made of a vibrationally non-damping material capable of sympathetically vibrating with the reed.

13. The mouthpiece assembly of claim 12 wherein said ligature seating groove is a channel said to accommodate said resilient band and is disposed approximately midway between a proximal tip of said proximal portion and a distal end of said distal portion.

14. The mouthpiece assembly of claim 12 further including an additional ligature seating groove for seating an additional resilient band.

15. The mouthpiece assembly of claim 14 wherein said additional ligature seating groove is disposed midway between said ligature seating groove and a distal end of said distal portion.

16. The mouthpiece assembly of claim 1 wherein said proximal tip portion includes a tip with a width that is substantially equal to the width of the tip of the reed.

17. The mouthpiece assembly of claim 1 wherein said distal chamber portion includes a barrel mating section with at least two seating grooves for accommodating two respective resilient bands, said bands being sized so as to promote an air-tight seal when said mating section is inserted into the barrel of a clarinet, and said resilient bands being of a width that is substantially less than the length of said barrel mating section.

* * * * *

UNITED STATES PATENT AND TRADEMARK OFFICE

CERTIFICATE OF CORRECTION

PATENT NO. : 5,192,821

DATED : March 9, 1993

INVENTOR(S) : Bradley Goldstein and Martin Goldstein

It is certified that error appears in the above-identified patent and that said Letters Patent is hereby corrected as shown below:

Column 3, line 31, delete "10%", and substitute therefor -- 1% --;

Column 3, line 35, delete "grove", and substitute therefor -- groove --;

Column 5, line 13, delete "resonance promoting", and substitute therefor -- resonance-promoting --;

Claim 5, column 6, line 16, delete "s", and substitute therefor -- is --;

Claim 12, column 6, line 46, after "ligature", insert -- seating --;

Claim 13, column 6, line 50, delete "said", and substitute therefor -- sized --.

Signed and Sealed this

Twenty-fifth Day of January, 1994

*Attest:*

Bruce Lehman

BRUCE LEHMAN

*Attesting Officer*

*Commissioner of Patents and Trademarks*